United States Patent [19]

Ueda

[11] 4,319,720

[45] Mar. 16, 1982

[54] YARN KNOTTING OPERATION CONTROL APPARATUS IN AUTOMATIC WINDER

[75] Inventor: Yutaka Ueda, Naraken, Japan

[73] Assignee: Murata Kikai Kabushiki Kaisha, Japan

[21] Appl. No.: 172,383

[22] Filed: Jul. 25, 1980

[30] Foreign Application Priority Data

Jul. 17, 1979 [JP] Japan ..... 54-96432[U]

[51] Int. Cl.[3] ..... B65H 54/20; B65H 54/22; B65H 63/00

[52] U.S. Cl. ..... 242/35.5 R; 242/35.6 R; 242/36

[58] Field of Search ..... 242/35.5 R, 35.6 R, 242/35.6 E, 36, 37, 18 R, 18 DD

[56] References Cited

U.S. PATENT DOCUMENTS

| | | | |
|---|---|---|---|
| 2,679,361 | 5/1954 | Furst | 242/35.5 R |
| 2,783,950 | 3/1957 | Furst | 242/35.5 R |
| 2,908,029 | 10/1959 | Furst | 242/35.5 R X |
| 3,067,962 | 12/1962 | Furst | 242/35.5 R |
| 3,070,320 | 12/1962 | Reiners et al. | 242/35.5 R |
| 3,077,311 | 2/1963 | Furst | 242/35.5 R |
| 3,918,651 | 11/1975 | Uchida | 242/35.6 R |

*Primary Examiner*—Stanley N. Gilreath
*Attorney, Agent, or Firm*—Whittemore, Hulbert & Belknap

[57] ABSTRACT

A yarn knotting operation control apparatus for an automatic winder including a plurality of winding units and a yarn knotting device comprises one air conduit for supplying suction air stream used for performing the yarn knotting operation, a blower connected to the air conduit, devices for detecting whether or not the normal travel of yarns is performed in the respective winding units, devices for initiating the yarn knotting operation and a control device having a memory device for storing signals from the detection device and means for putting out signals of the yarn knotting operation.

9 Claims, 11 Drawing Figures

Fig. 4-a
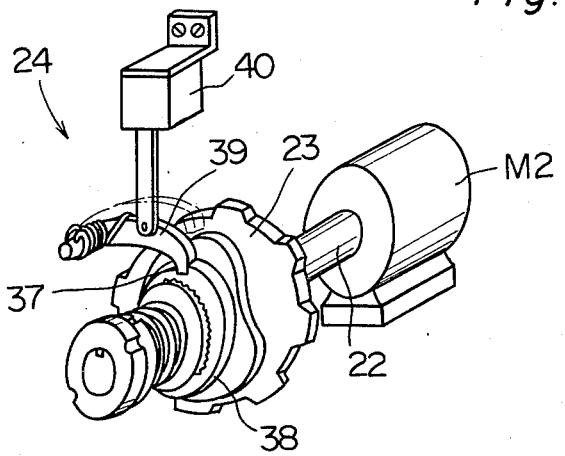
Fig. 4-b
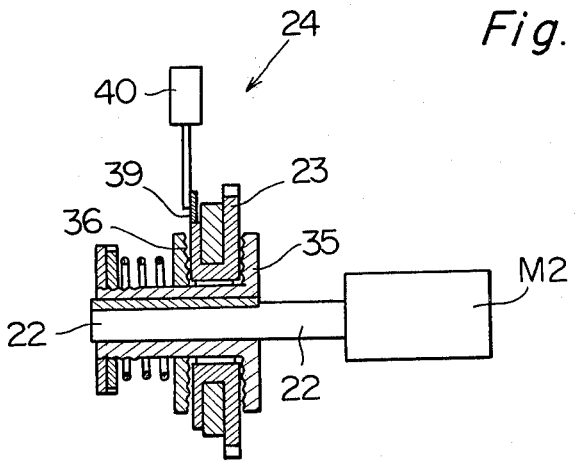

YARN KNOTTING OPERATION CONTROL APPARATUS IN AUTOMATIC WINDER

BACKGROUND OF THE INVENTION

It is known that in an automatic winder comprising a plurality of winding units arranged in parallel, one air conduit is disposed and used in common for supplying suction air streams used for performing the yarn knotting operation to the respective winding units and one blower is connected to said air conduit. In this automatic winder, the capacity of the blower is so large that even if the yarn knotting operation is performed simultaneously in all the winding units, the yarn knotting operation can be conducted normally. However, from experience, it has been confirmed that among 50 units, only 3 to 10 units require the yarn knotting operation simultaneously, and it seldom happens that all the capacity for 50 units is necessary. Accordingly, there was adopted a method in which a blower having a capacity for 10 units is used and in the winding units where the first yarn knotting operation is unsuccessful, the second yarn knotting operation is conducted with an intention that since the number of the winding units where the second knotting operation is required is reduced because th second knotting operation need not be performed in the winding units where the first knotting operation has been successful. This method, however, is defective in that when in more than 10 of winding units, the knotting operation is carried out simultaneously, it is impossible to operform the yarn knotting operation successfully in 10 or more of the winding units and the number of the winding units where the yarn knotting operation can be performed successfully is reduced, leading to wasteful consumption of the energy.

The applicant already proposed a method in which two blowers having a small capacity are connected, one blower is always used and only reduction of the pressure in the air conduit is detected, the second blower is operated. However, this method is defective in that a certain time is required for imparting the effect of the second blower to the respective winding units through the air conduit, and from the viewpoint of the running cost, the method is disadvantageous in that a motor which is seldom used should be disposed.

SUMMARY OF THE INVENTION

The present invention relates to a yarn knotting operation control apparatus in an automatic winder. More particularly, the invention relates to a yarn knotting operation control apparatus in which a blower having a capacity sufficient to actuate a predetermined number of winding units simultaneously is disposed and in the winding units where the yarn knotting operation is required, the yarn knotting operation is performed in an order predetermined according to the capacity of the blower.

The yarn knotting operation control apparatus of the present invention includes one air conduit for supplying suction air stream used for performing the yarn knotting operation, a blower connected to the air conduit, a detecting device whether the mormal travel of yarns is performed in a winding unit, a device for initiating the yarn knotting operation and a control device having a memory device for storing signals from the detecting device and means for putting out signals of the yarn knotting operation.

In accordance with the present invention, there is provided an apparatus in which a blower having a capacity sufficient to perform the yarn knotting operation simultaneously in, for example 2 winding units is disposed and when this blower is operated, suction air streams making the yarn knotting operation successfully in two winding units without fail are produced.

The capacity of the blower may be reduced according to the kind of the yarn and the number of winding units from which the requirement for the yarn knotting operation is emitted. That is, a motor having a small capacity can be used for the blowers. Furthermore, the yarn knotting operation can be performed successfully without fail even if the yarn knotting operation is performed in a maximum number, allowed by the capacity of the blower of the winding units.

BRIEF DESCRIPTION OF DRAWING:

FIG. 4-*a* is a perspective view showing a device for initiating the yarn knotting operation, which includes a one-rotation clutch, and FIG. 4-*b* is a sectional view of this starting device;

Figure 1:
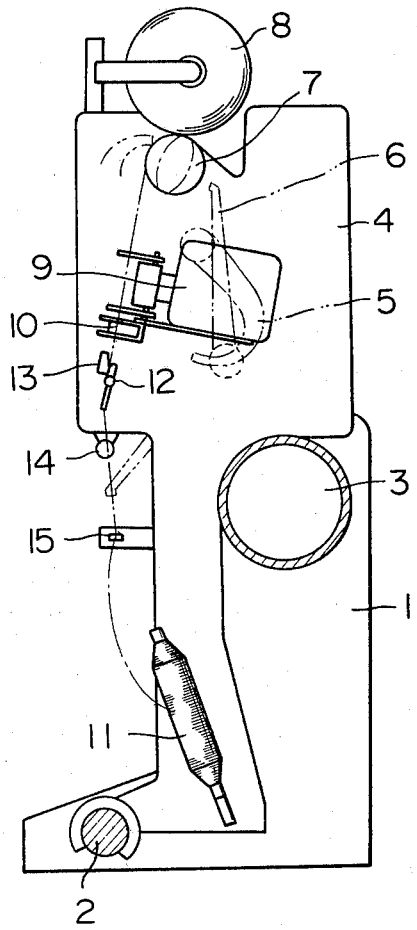
FIG. 1 is a longitudinally sectional side view showing an automatic winder.

DETAILED DESCRIPTION OF THE INVENTION:

The present invention will now be described in detail with reference to the accompanying drawings. The winding units are first described. Referring to FIG. 1, a great number of winding units are mounted and fixed to a shaft 2 and air conduit 3 supported by an end frame 1 of the automatic winder. A suction nozzle 5 for sucking and catching the yarn end from a winding package 8 is connected to the air conduit 3, and a suction nozzle 6 is disposed to suck and catch the yarn end form a cop 11. By turning movements of the suction nozzles 5 and 6, both the yarn ends are guided into a knotter 9 and the yarn knotting operation is accomplished by the knotter 9. While the yarn to be wound is travelling, the yarn undergoes actions of a balloon breaker 15, a tension device 14, a yarn breakage detecting feeler 12 which detects that the normal yarn travel is not performed and operates a microswitch 13, a slub catcher 10 and a traverse drum 7.

Figure 2:
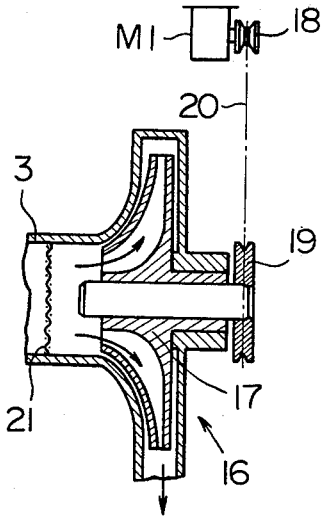
FIG. 2 is a sectional view showing the portion of the blower in the winder shown in FIG. 1.

A blower 16 is connected to the end of the air conduit 3 as shown in FIG. 2. This blower 16 comprises a fan 17 and a driving motor M1, and the rotation of the motor M1 is transmitted to the fan 17 through a belt 20 stretched between pulleys 18 and 19. Air streams in the air conduit 3 flow outward through a net 21 to form a negative pressure in the air conduit 3 and produce sucking forces of the suction nozzles 5 and 6. In the present invention, the capacity of the blower may be adjusted to a level capable of performing the yarn knotting operation in one winding unit, but the capacity of the blower is ordinarily determined according to the stand-by time which is changed by the number of winding units from which instructions of the yarn knotting operation are simultaneously emitted.

Figure 3:
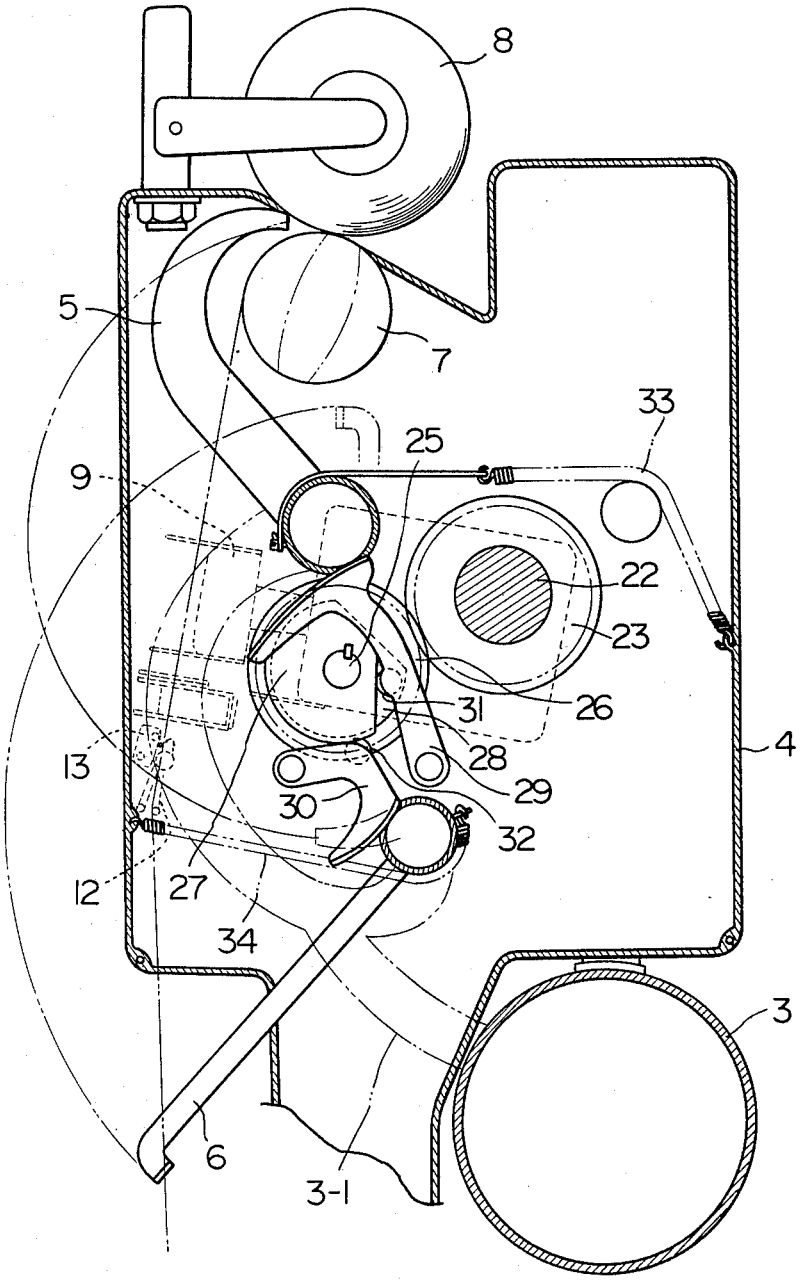
FIG. 3 is a side view showing the structural members participating in the yarn knotting operation.

Referring to FIG. 3 illustrating in detail members participating in the yarn knotting operation in the winding unit 4, a one-rotation clutch 24 described hereinafter is disposed between a main shaft 22 and a gear 23. When the gear 23 rotates, also a gear 26 fixed to a shaft 25 rotates and cams 27 and 28 fixed to the shaft 25 rotate. Rollers 31 and 32 of fan-shaped gears 29 and 30 turnable with one axis being as the center are pressed to the cams 27 and 28 respectively. With the turning movements of the cams 27 and 28, the fan-shaped gears 29 and 30 turn and the suction nozzles 5 and 6 engaged with the gears 29 and 30 are caused to turn against springs 33 and 34, and an air passage 3-1 extending from the air conduit 3 to the suction nozzles 5 and 6 and a shutter (not shown) disposed between the suction nozzles 5 and 6 are opened and the suction nozzles 5 and 6 suck and catch the yarn ends at position indicated by solid lines in FIG. 3 while maintaining the sucking forces. Then, the suction nozzles 5 and 6 are returned to the original positions and guide the yarn ends into the knotter 9 to effect the yarn knotting operation, and the shutter (not shown) of the suction nozzles is closed and the sucking forces of the suction nozzles are lost.

One embodiment of the one-rotation clutch 24 acting as the device for initiating this knotting operation is illustrated in FIG. 4. In this embodiment, a motor M2 is independently disposed, but there may be adopted a method in which a line shaft extending in the longitudinal direction of the automatic winder is driven and a power is obtained from this shaft. Referring to FIG. 4, the gear 23 is fitted between a friction plate 35 fixed to the main shaft 22 and a friction plate 36 which is spring-urged and slidably mounted on the shaft 22, and a concave groove 37 is formed on a cam 38 formed integrally with the gear 23 and a pawl 39 engaged with the concave groove 37 is arranged so that by operating the pawl 39 by a solenoid 40, the yarn knotting operation is initiated. Thus, the device for initiating the yarn knotting operation is constructed. This one-rotation clutch is disposed for each winding unit.

Figure 5:
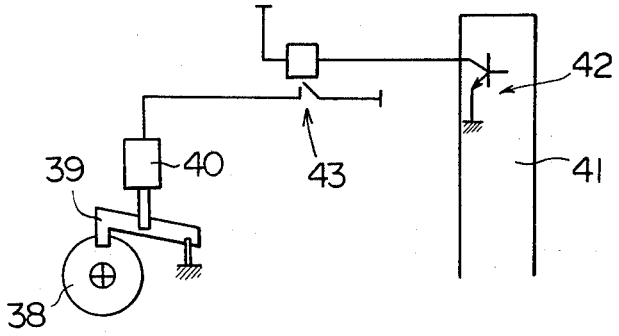
FIG. 5 is a circuit diagram of the device for initiating the yarn knotting operation.

As shown in FIG. 5, when a switching circuit 42 of an output portion 41 of the control device is put on, a relay 43 is actuated to operate the solenoid 40.

Figure 6:
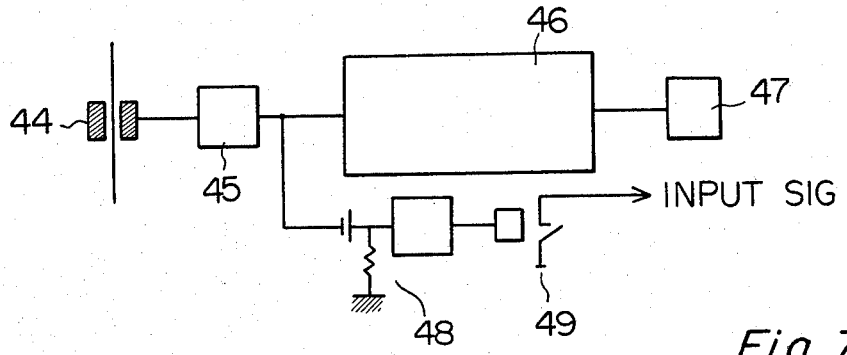
FIG. 6 is a circuit diagram of a second embodiment of a device for detecting whether or not the normal travel of the yarn is performed.
Figure 7:
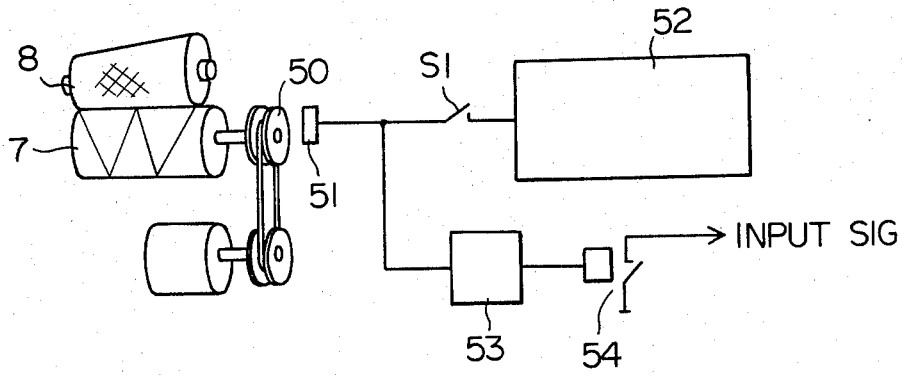
FIG. 7 is a circuit diagram illustrating a third embodiment of the detecting device.
Figure 8:
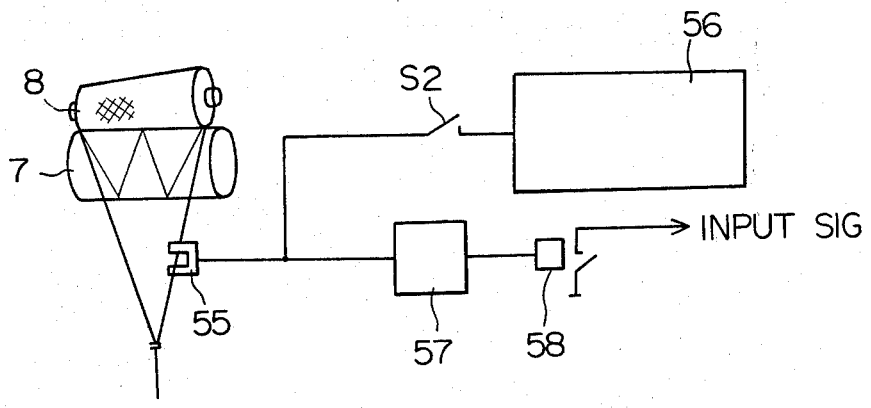
FIG. 8 is a circuit diagram illustrating a fourth embodiment of the detecting device.

In FIG. 1, as the device for detecting whether or not the normal travel of the yarn is performed, there is illustrated a device in which the yarn is directly hung on a yarn breakage detecting feeler and when the yarn does not normally travel, the sensor 12 is displaced by the gravity and separation of the sensor from an actuator of the microswitch is detected to produce an input signal to the control device (see FIG. 3). The detecting means is not limited to such detecting device, the travel of the yarn may be detected from other places. In an embodiment shown in FIG. 6, the slub catcher 10 is utilized. More specifically, a signal from a static capacity sensor 44 is put in an ordinary slub detecting circuit 46 through an amplifying circuit 45 to actuate a cutter 47 while exerting a function of an electronic slub catcher for cutting a slub yarn on one hand, and the signal from the amplifying circuit 45 actuates a relay 49 through an amplifying circuit 48 to put into the control device a signal indicating that the yarn is not normally travelled on the other hand. The detecting device shown in FIGS. 7 and 8 is disposed in a full bobbin doffing signal system for measuring the size of a package and exchanging the package with an empty package when the size of the package is increased to a predetermined level. Ordinarily, when packages are exchanged, on attaching the yarn extending between the package and cop to a new empty paper spool, the yarn is gripped between the paper spool and bobbin holder and the yarn end is connected to the new paper spool. Accordingly, in this case, the suction nozzles 5 and 6 and knotter 9 are not used at all. However, when the yarn is cut on receipt of a constant length signal and a new paper spool having a small quantity of the yarn wound thereon, which is called "starter", is used, the suction nozzles 5 and 6 and knotter 9 should be used. Accordingly, they can be used also as the detecting device. In an embodiment shown in FIG. 7, a magnet 50 is attached to the drum 7 or a pulley fixed to the drum shaft. A sensor 51 detects the rotation number of the drum, and it puts the detected rotation number into a constant length counter 52 on one hand and also it puts the detected rotation number into an amplifying circuit 53 and emits an input signal to the control device through a relay 54 on the other hand. In an embodiment shown in FIG. 8, a signal indicating the yarn traversed by the traverse drum 7 travels across a photoelectronic sensor 55 is put into an ordinary constant length counter 56 on one hand, and this signal is supplied to the control device as an input signal through an integrating amplifying circuit 57 according to the operation of relay 58 on the other hand.

A control device will now be described.

Figure 9:
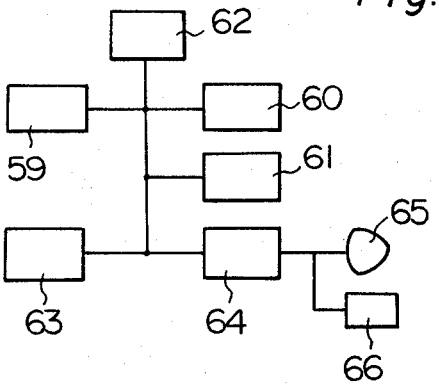
FIG. 9 is a block diagram showing one embodiment of a control device.
Figure 10:
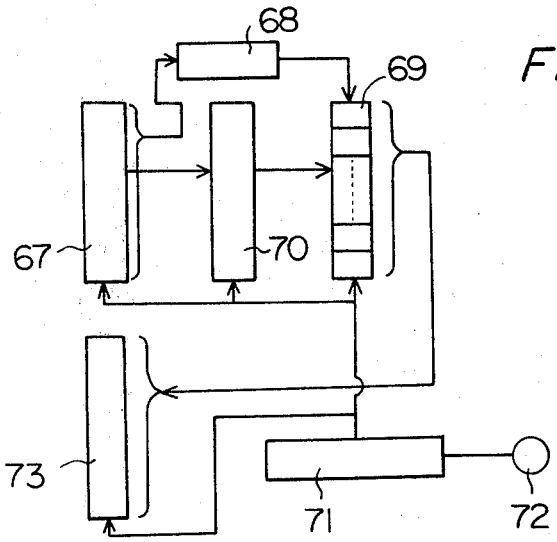
FIG. 10 is a block diagram showing a second embodiment of the control device.

An embodiment of the control device including a computer is shown i FIG. 9, and another embodiment including a logic circuit is shown in FIG. 10.

Referring to FIG. 9, when the requirement for the yarn knotting operation is emitted as an input signal from the above-mentioned detecting device disposed in the winding unit, data are put in through an interface 59 having the capacity of temporarily storing a simultaneous input signal and the requirement for the knotting operation in the specific winding unit is stored in a memory storage 60. This storage is effected every time the requirement for the knotting operation is emitted from the respective winding units. On the other hand, according to a program put in a program memory 61, for examples, a program in which the signal is put first in the winding unit which first emits the instruction of the yarn knotting operation and the signals are then put into the winding units in an order of emission of the instruction signals or a program in which the capacity of the blower is adjusted so that the yarn knotting operation is performed simultaneously in two winding units, the operation is conducted in a computing device 62 according to the capacity of the blower, and data are put out through an interface 63 and the putout signals actuate the solenoids shown in FIG. 4 or 5 to effect the yarn knotting operation.

Data of the computing device 62 are put out into a display device 65 through an input and output interface 64. Signals for changing the program and other interuption signals, for example, signals of changing the 2-unit capacity of the blower to the 3-unit capacity, are put in the program memory 61 from an operation device 66 through the interface 64.

Referring to FIG. 10, input signals from the respective winding units are temporarily stored in an input buffer circuit 67, and on one hand, the input signals are put into a shift register 69 through a shift register controller 68 from the buffer circuit 67 and on the other hand, the input signals are put into a shift register 69 through a timing gate 70 from the buffer circuit 67. Instructions of the yarn knotting operation in the respective winding units, which are put in the shift register in an order and stored therein are put out into the respective winding units through an output buffer circuit 73 as output signals to actuate the solenoids 40 of the winding units shown in FIG. 5 to effect the yarn knotting operation. A timing control circuit 71 is disposed so that the timings of each of the above-mentioned circuits are controlled by signals of an oscillator 72. In short, a function regarded as a scaning operation is exerted and the stored signals are treated according to the time division system.

When the yarn breakage feeler 12 shown in FIG. 1 is displaced because of occurrence of yarn breakage, the microswitch 13 is put on, and when this put-on signal is put into the interface 59 shown in FIG. 9 as the input signal, the signal is stored in the memory 60. At this point, if the signal of the requirement for the yarn knotting operation is not emitted from any of the winding units, even when the blower 16 has a capacity of performing the yarn knotting operation in two winding units, an instruction of the yarn knotting operation may be given. Accordingly, the output signal is emitted through the interface 63, and the solenoid 40 is put on and the gear 23 makes one rotation, whereby both the yarn ends are sucked and caught by the suction nozzles 5 and 6 and guided into the knotter 9 and the yarn knotting operation is performed by the knotter 9. Then, the sucking forces of the suction nozzles are lost. Since the time required for one rotation of the gear 23 is constant, the solenoid 40 of the other winding unit from which the requirement for the yarn knotting operation is emitted may be actuated just after passage of the above-mentioned time. In the case where the capacity of the blower is such as capable of performing the yarn knotting operation simultaneously in two winding units, when the yarn knotting operation has already started in two winding units, a control is made by the program memory 61 so that the input signal from the sensor is stored and retained in the memory storage 60, and any output signal is not emitted.

The above-mentioned operations are similarly conducted in the embodiment of FIG. 10 except that this embodiment is different from the above embodiment using the program in that the shift resistors 69 are operated in order.

What is claimed is:

1. A yarn knotting operation control apparatus in an automatic winder having a plurality of winding units arranged in parallel including one air conduit which is used in common for performing the yarn knotting operation to the respective winding units, one blower connected to the air conduit, the capacity of said blower being adjusted so that the blowing capacity is smaller than the blowing capacity capable of performing the normal yarn knotting operation when all the winding units use the suction air streams simultaneously, devices for detecting whether or not the normal travel of yarns is performed in the respective winding units, devices for initiating the yarn knotting operation on receipt of instruction signals of the yarn knotting operation, and a control device comprising a memory storage for storing signals from the detecting devices of the respective winding units and means for putting out signals of the yarn knotting operation to the yarn knotting operation-initiating devices in an order predetermined with respect to the capacity of the blower.

2. An apparatus as claimed in claim 1, wherein said detecting device comprises a yarn breakage detecting feeler, a sensor and a microswitch.

3. An apparatus as claimed in claim 1, wherein said detecting device comprises a static capacity sensor of a slub catcher, amplifying circuits and a relay through which a signal is put into the control device.

4. An apparatus as claimed in claim 1, wherein said detecting device comprises a magnet mounted on a drum shaft, a sensor for detecting the rotation number of the drum, an amplifying circuit and a relay through which an input signal to the control device is emitted.

5. An apparatus as claimed in claim 1, wherein said detecting device comprises a photoelectronic sensor for sensing a yarn traversed by a traverse drum, an amplifying circuit and a relay through which an input signal to the control device is emitted.

6. An apparatus as claimed in claim 1, wherein said device for initiating the yarn knotting operation comprises an one-rotation clutch and a solenoid, said one-rotation clutch including a main shaft, a gear fitted between a friction plate fixed to the main shaft and a friction plate which is spring-urged and slidably mounted on the shaft, a cam formed integrally with the gear and having a concave groove formed thereon, and a pawl engaged with the concave groove and arranged so that the yarn knotting operation is initiated by operating the pawl by the solenoid.

7. An apparatus as claimed in claim 1, wherein said control device includes a memory storage for storing the requirement for the knotting operation put in through an interface, a program memory and a computing device in which the operation is conducted according to the capacity of the blower and signals put out through an interface for actuating the solenoid of the yarn knotting operation-initiating device.

8. An apparatus as claimed in claim 7, wherein said control device further includes a display device and an operation device for changing the program ad other interruption signals.

9. An apparatus as claimed in claim 1, wherein said control device is a logic circuit including a buffer circuit, a shift register into which the input signals are put through a shift resistor controller or through a timing gate from the buffer circuit and stored, an output buffer circuit through which output signals to actuate the solenoid of the yarn knotting operation-initiating device are put out, and a timing control circuit with an oscillator.

* * * * *